US006509724B1

(12) United States Patent
Ilic et al.

(10) Patent No.: US 6,509,724 B1
(45) Date of Patent: Jan. 21, 2003

(54) HOUSEKEEPING POWER SUPPLY FOR ELECTRONICALLY CONTROLLED LOADS

(75) Inventors: Milan Zarko Ilic, Clifton Park; Frank Jakob John Mueller, Scotia, both of NY (US)

(73) Assignee: General Electric Company, Niskayuna, NY (US)

( * ) Notice: Subject to any disclaimer, the term of this patent is extended or adjusted under 35 U.S.C. 154(b) by 26 days.

(21) Appl. No.: 09/698,794

(22) Filed: Oct. 27, 2000

(51) Int. Cl.[7] ..... G05F 1/40
(52) U.S. Cl. ..... 323/284; 323/239; 323/282
(58) Field of Search ..... 323/239, 282, 323/284, 265, 266, 268, 272, 274, 271, 324, 351, 125

(56) References Cited

U.S. PATENT DOCUMENTS 4,321,526 A * 3/1982 Weischedel ..... 323/284
5,302,889 A * 4/1994 Marsh ..... 323/284
6,094,040 A * 7/2000 Meier et al. ..... 323/282

* cited by examiner

*Primary Examiner*—Robert E. Nappi
*Assistant Examiner*—Gary L. Laxton
(74) *Attorney, Agent, or Firm*—Jill M Breedlove; Christian G. Cabou

(57) ABSTRACT

A circuit for loading the rectified AC voltage bus in a housekeeping power supply for an electronically controlled load is provided for avoiding large increases in the rectified AC bus voltage upon disconnecting the load. The load circuit includes a current sink, a relatively small energy storage capacitance, and a negative feedback circuit. The current sink includes a resistance coupled to the rectified AC voltage bus for sinking current whenever the semiconductor switch is on. When the semiconductor switch is off, the small capacitance discharges through the resistive voltage divider. When the voltage across the small capacitance decreases to a threshold mean AC rectified voltage bus value, then the negative feedback circuit provides sufficient current to turn the semiconductor switch back on and thus provide approximately the threshold mean AC rectified voltage bus value. Diodes are provided on the AC rectified voltage bus in order to ensure fast feedback and to separate the current sink resistance from the remainder of the housekeeping supply during normal circuit operation.

4 Claims, 5 Drawing Sheets

Rectified AC bus voltage with invented circuit α=145° and load off

Rectified AC bus voltage with load on for α=145°

Rectified AC bus voltage without load on for α=145°

HOUSEKEEPING POWER SUPPLY FOR ELECTRONICALLY CONTROLLED LOADS

BACKGROUND OF THE INVENTION

The present invention relates generally to power supplies for electronically controlled loads and, more particularly, to such a power supply that avoids a large mean rectified AC voltage increase when the load is disconnected, thereby simplifying the control circuit requirements for the electronically controlled load.

In an electronically controlled load, such as of a type supplied by the output of a dimmer circuit in a lamp ballast application, for example, the output load needs to be turned off when the mean rectified AC voltage falls under a safe operating value or under a value for which the circuit will not operate properly. Unfortunately, with no output load connected to the dimmer or rectified AC voltage bus, the mean rectified voltage rises close to the peak value of the input voltage. This makes difficult the design of the voltage sensing and power control circuitry for the electronically controlled load.

Accordingly, it is desirable to provide a practicable solution for avoiding a large mean rectified AC voltage jump and thereby enabling simplification of the voltage sensing and power control circuitry for electronically controlled loads.

BRIEF SUMMARY OF THE INVENTION

In a housekeeping power supply for an electronically controlled load, circuitry is provided for avoiding large increases in the rectified AC bus voltage upon disconnecting the load. The housekeeping power supply for an electronically controlled load is of a type having a semiconductor switch coupled to a rectified AC voltage bus, the switch operating with a Zener diode as a series regulator for providing an output voltage across a resistive voltage divider. The load circuit comprises a current sink, a relatively small energy storage capacitance, and a negative feedback circuit. In an exemplary embodiment, the current sink comprises a resistance coupled to the rectified AC voltage bus for sinking current whenever the semiconductor switch is on. When the semiconductor switch is off, the small capacitance discharges through the resistive voltage divider. When the voltage across the small capacitance decreases to a threshold mean AC rectified voltage bus value, then the negative feedback circuit provides sufficient current to turn the semiconductor switch back on and thus provide approximately the threshold mean AC rectified voltage bus value. The negative feedback circuit time constant, as determined by the small capacitance and the resistive voltage divider, is selected to be sufficiently shorter than the period of the input voltage in order to provide fast feedback response. Diodes are provided on the AC rectified voltage bus in order to ensure fast feedback and to separate the current sink from the remainder of the housekeeping supply during normal circuit operation, i.e., when the electronically controlled load is connected to the supply.

DETAILED DESCRIPTION OF THE INVENTION

Figure 1:
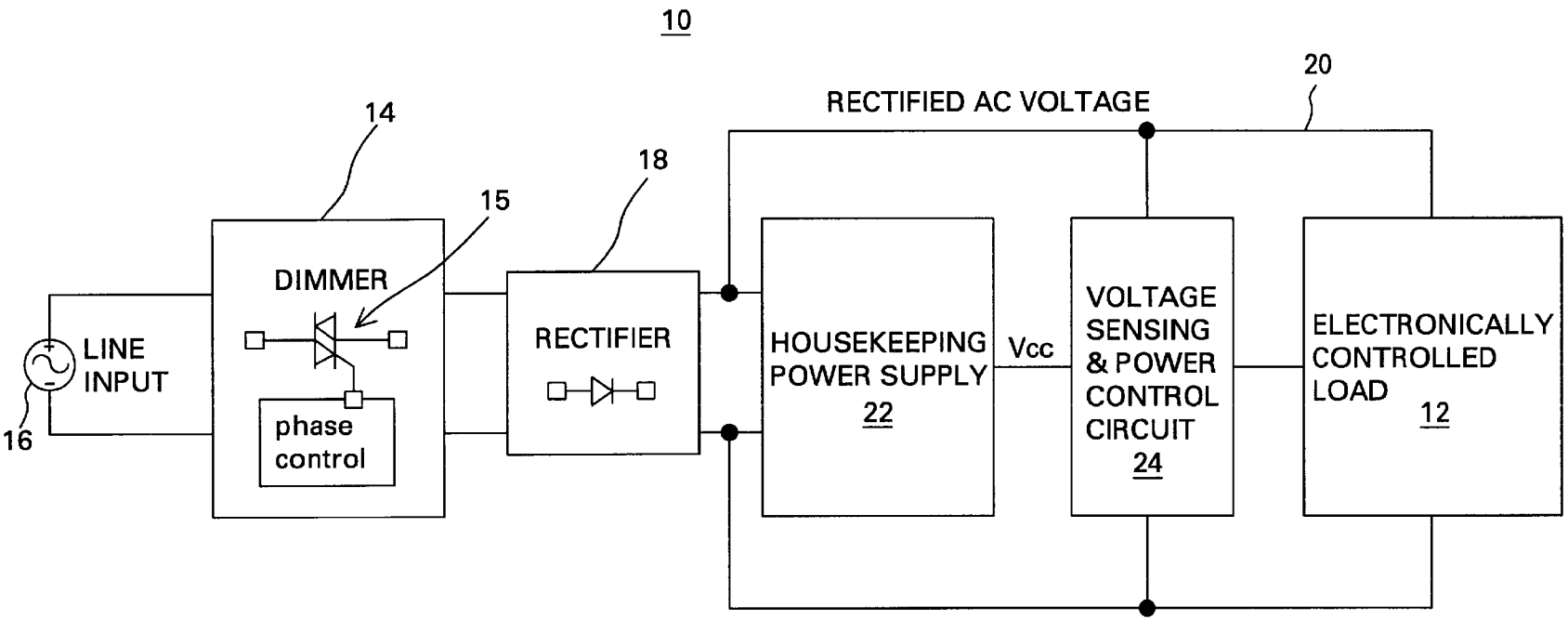
FIG. 1 (PRIOR ART)
FIG. 1 is a block diagram illustrating a typical system configuration for an electronically controlled load.

FIG. 1 illustrates a typical system configuration 10 for an electronically controlled load 12. By way of example, the system of FIG. 1 is illustrated as comprising a lamp ballast application with a dimmer circuit 14. As illustrated, an input ac line voltage 16 is applied to the dimmer circuit 14, the output of which is provided to a rectifier 18. The rectified AC line voltage from rectifier 18 is provided via a rectified AC voltage bus 20 to a housekeeping power supply 22, a voltage sensing and power control circuit 24, and the electronically controlled load 12, e.g., a lamp and ballast. Housekeeping power supply 22 provides a DC voltage Vcc to the voltage sensing and power control circuit 24. The voltage sensing and power control circuit 24 senses the rectified AC voltage and generates a signal for correlating the power of the electronically controlled load 12 to the signal generated by the dimmer circuit 14.

Figure 2:
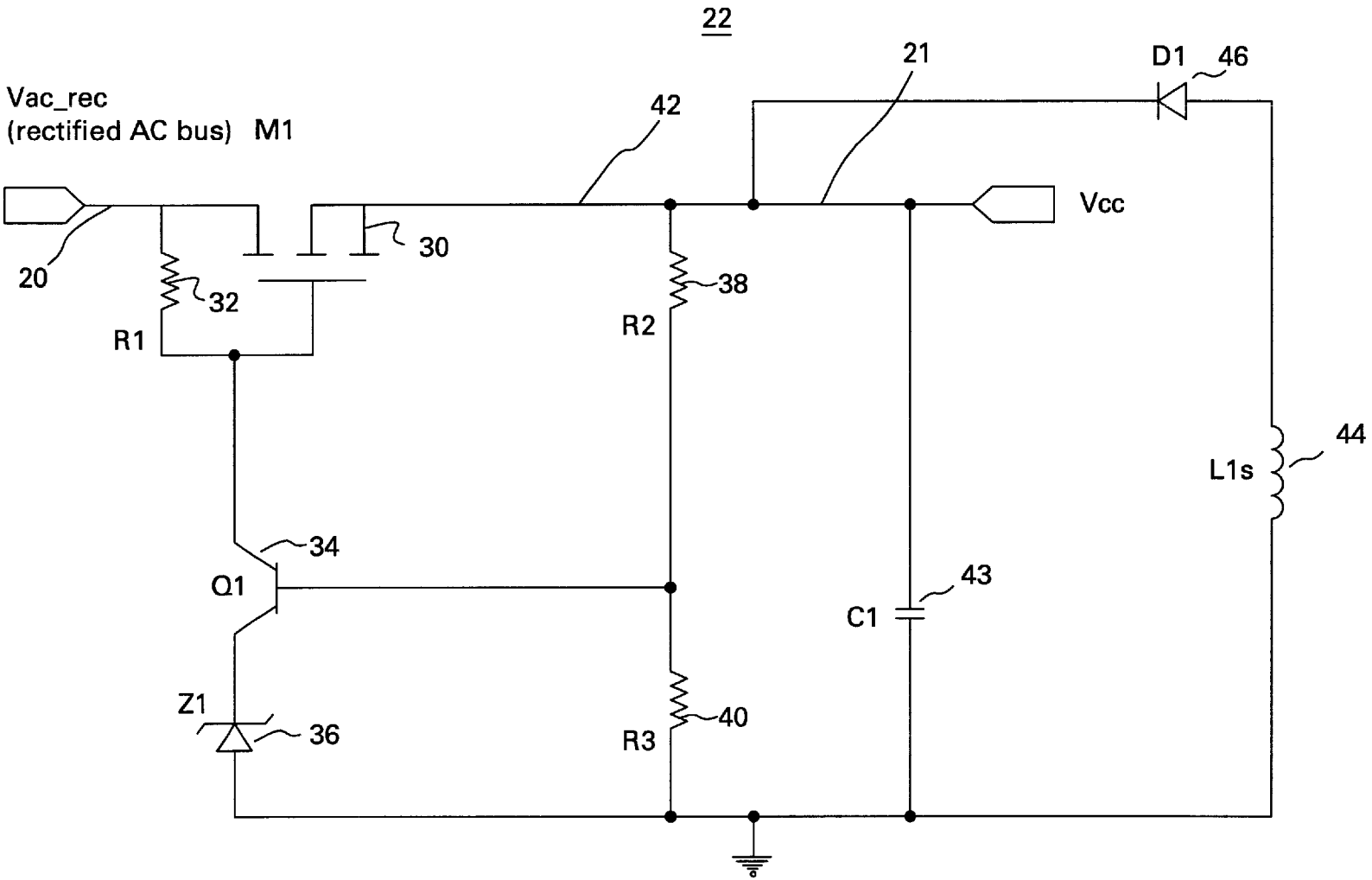
FIG. 2(PRIOR ART)
FIG. 2 schematically illustrates a typical housekeeping power supply used in a system such as that of FIG. 1.

FIG. 2 illustrates a typical housekeeping power supply 22, such as may be used in the system of FIG. 1. Housekeeping supply 22 comprises a MOSFET 30 (M1) having a resistance 32 (R1) coupled between the source and gate thereof. The resistor R1 is connected in series with a switching device 34 (Q1) and a Zener diode 36 (Z1). The base (or gate) of switching device 34 is coupled to a junction between two resistors 38 and 40 (R2 and R3) which form a resistive voltage divider 42. A capacitor 43 (C1) is connected in parallel with resistive voltage divider 42. A voltage source 44, illustrated in FIG. 2 as an inductive winding 44 (L1s), is connected to an output DC voltage bus 21 via a diode 46 (D1). The additional winding 44 typically comprises an additional winding from a magnetic component (not shown) located elsewhere within the system, such as, for example, a high-frequency transformer from a dc-to-dc converter or a power inductor.

In operation of the system of FIG. 1, the user sets the desired power level by adjusting the firing angle $\alpha$ of the dimmer's triac 15, thereby changing the mean value of the rectified AC voltage. (As is well-known in the art, a triac comprises a bidirectional controlled rectifier; in dimmer circuits, the triac controls the load voltage mean value by connecting the line to a load from the trigger angle $\alpha$ to 180° for each half cycle.) For example, when $\alpha$=145° for a 120V AC line, the mean value of the AC rectified voltage is about 9V. This is too low for most electronic loads, such as fluorescent lamps, for example; thus, the load circuit should be shut down. The problem is that with no output load connected to the dimmer or rectified AC voltage bus, the mean rectified voltage rises close to peak value of the input voltage. For example, when $\alpha$=145°, the peak value is 98V for a 120V AC line, and the mean rectified voltage is close to that value (i.e., 94V in a test circuit). The change in the rectified AC voltage (from 9V to 94V) when the output load is shut down makes difficult the design of the voltage sensing and power control circuitry for the electronically controlled load.

In the housekeeping power supply of FIG. 2, MOSFET 30 (M1) functions as a series regulator by providing the output voltage (e.g., on the order of 10V), as determined by the resistive voltage divider 42 and Zener diode 36. The housekeeping circuit of FIG. 2 operates efficiently as a start-up supply only, that is, with energy being obtained from another source during normal operation. In particular, if the voltage obtained from the additional winding L1s during normal circuit operation is higher than the voltage from the MOSFET M1, then switching device Q1 will turn off the MOSFET M1, thereby cutting off the initial source of energy from the rectified AC line voltage via MOSFET M1. When the firing angle $\alpha$ of the dimmer circuit reaches the maximum safe value for the output load, the control circuit shuts down the load, thereby cutting off energy provided via additional winding L1s to the housekeeping power supply.

Figure 3:
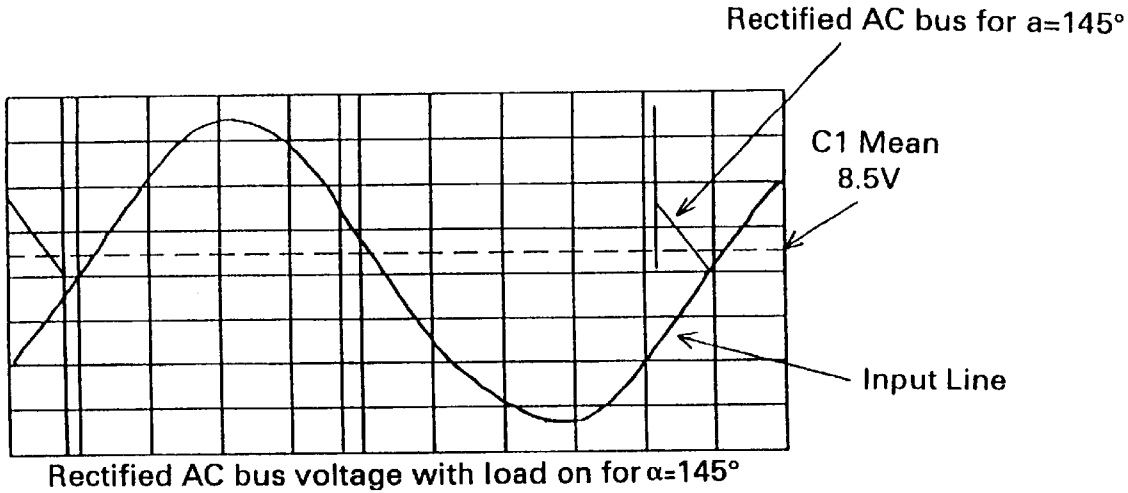
FIG.3(PRIOR ART)
FIG. 3 graphically illustrates a rectified AC bus voltage with the load connected for a trigger angle $\alpha$=145° for the circuit of FIG. 1.
Figure 4:
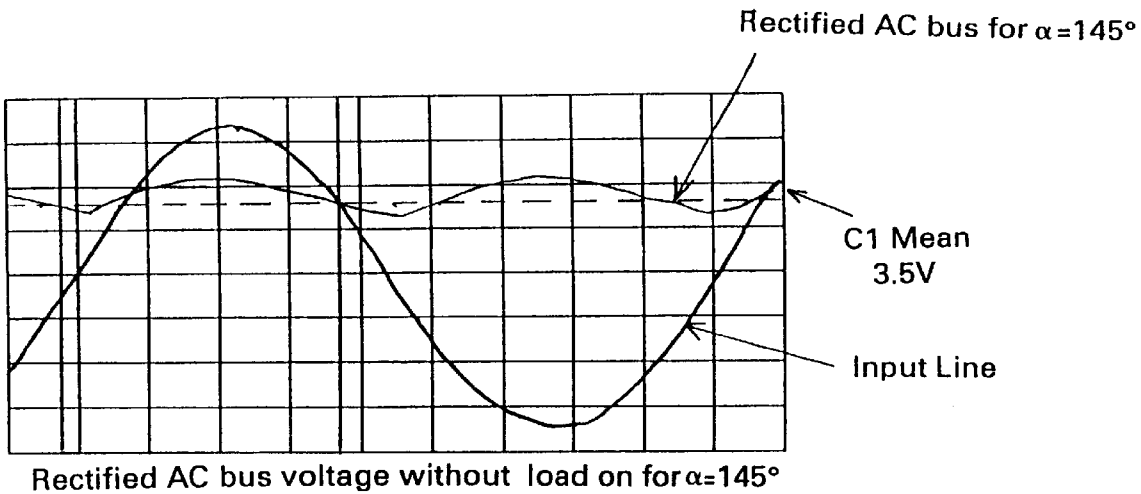
FIG.4(PRIOR ART)
FIG. 4 graphically illustrates a rectified AC bus voltage with the load disconnected for a trigger angle $\alpha$=145° for the circuit of FIG. 1.

FIG. 3 graphically illustrates a mean rectified AC bus voltage of approximately 9V during normal operation of the system of FIG. 1. FIG. 4 graphically illustrates a mean rectified AC bus voltage jump to approximately 94V in the system of FIG. 1 caused by disconnecting the load.

Figure 5:
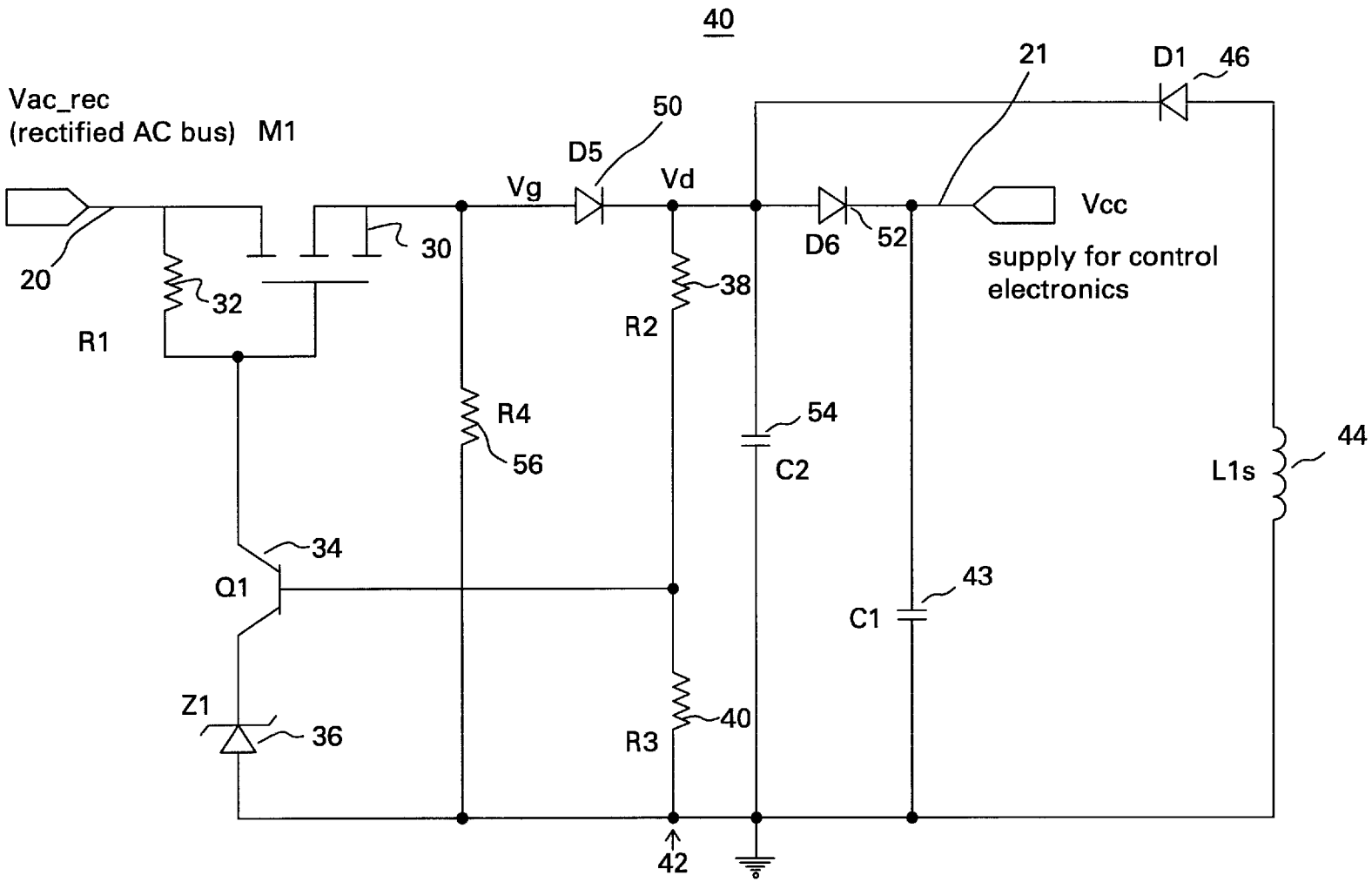
FIG. 5(PRIOR ART)
FIG. 5 schematically illustrates an exemplary housekeeping power supply in accordance with preferred embodiments of the present invention useful in a system such as that of FIG. 1, for example.

The present invention advantageously avoids a large mean rectified AC bus voltage jump, such as illustrated in FIG. 4. As an exemplary embodiment, FIG. 5 illustrates a housekeeping power supply 40 as an improvement over housekeeping power supply 22 of FIG. 2 for avoiding the large mean rectified AC bus voltage jump such as illustrated in FIG. 4. Furthermore, the housekeeping power supply of FIG. 5 is effective both as a start-up supply and a supply during normal circuit operation.

With respect to the housekeeping power supply of FIG. 2, the housekeeping supply of FIG. 5 comprises diodes 50 (D5) and 52 (D6) connected between MOSFET M1 and supply voltage Vcc. In addition, a capacitor 54 (C2) has been added between the junction joining diodes D5 and D6 and ground, and a resistor 56 (R4) has been added between the junction joining MOSFET M1 and diode D5 and ground.

During normal operation, i.e., with the output load on, the housekeeping power supply of FIG. 5 operates in similar manner as that of FIG. 2. In particular, energy is provided to the housekeeping power supply via the additional winding L1s, and the MOSFET M1 is off. When the firing angle $\alpha$ of the dimmer circuit reaches the maximum safe value for the output load, the control circuit shuts down the load, thereby cutting off energy provided via additional winding L1s to the housekeeping power supply.

While the MOSFET M1 is off, capacitor C2 discharges through the resistive divider R2 and R3. When the voltage across capacitor C2 drops under the nominal level (e.g., 10V), negative feedback provided by the circuit comprising R2, R3, Q1, and Z1 turns on the MOSFET M1 in order to keep the voltage Vd close to the nominal level (e.g., 10V). Additionally, in order to achieve fast feedback response, the time constant (R2+R3)·C2 is selected to be much shorter than the period of the input voltage. In particular, capacitor C2 and diode D6 enable this fast response, which capacitor C2 having a much smaller capacitance value than that of capacitor C1 which is large enough to store sufficient energy for the control circuit to operate between AC line cycles.

Resistor R4 has been added to load the rectified AC voltage bus and thus sink current whenever the MOSFET M1 is turned on, thereby keeping the dimmer's triac in its on-state. Assuming the control circuit current is negligible, the current through MOSFET M1 is given by Id=Vs/Rl such that the circuit of FIG. 5 operates effectively as a constant current load. The effect of adding this constant current load to the rectified AC bus causes the dimmer circuit's triac to trigger every cycle and thereby provides an accurate representation of the power supplied from the dimmer. The value of resistor R4 is chosen to keep the triac turned on by providing the triac with its minimum holding current every time it is triggered. Resistor R4 thus is selected to have a relatively low resistance value. For example, with a triac holding current of 20 mA and an output voltage of 10V, the value of resistance R4 is selected to be 500 ohms.

Figure 6:
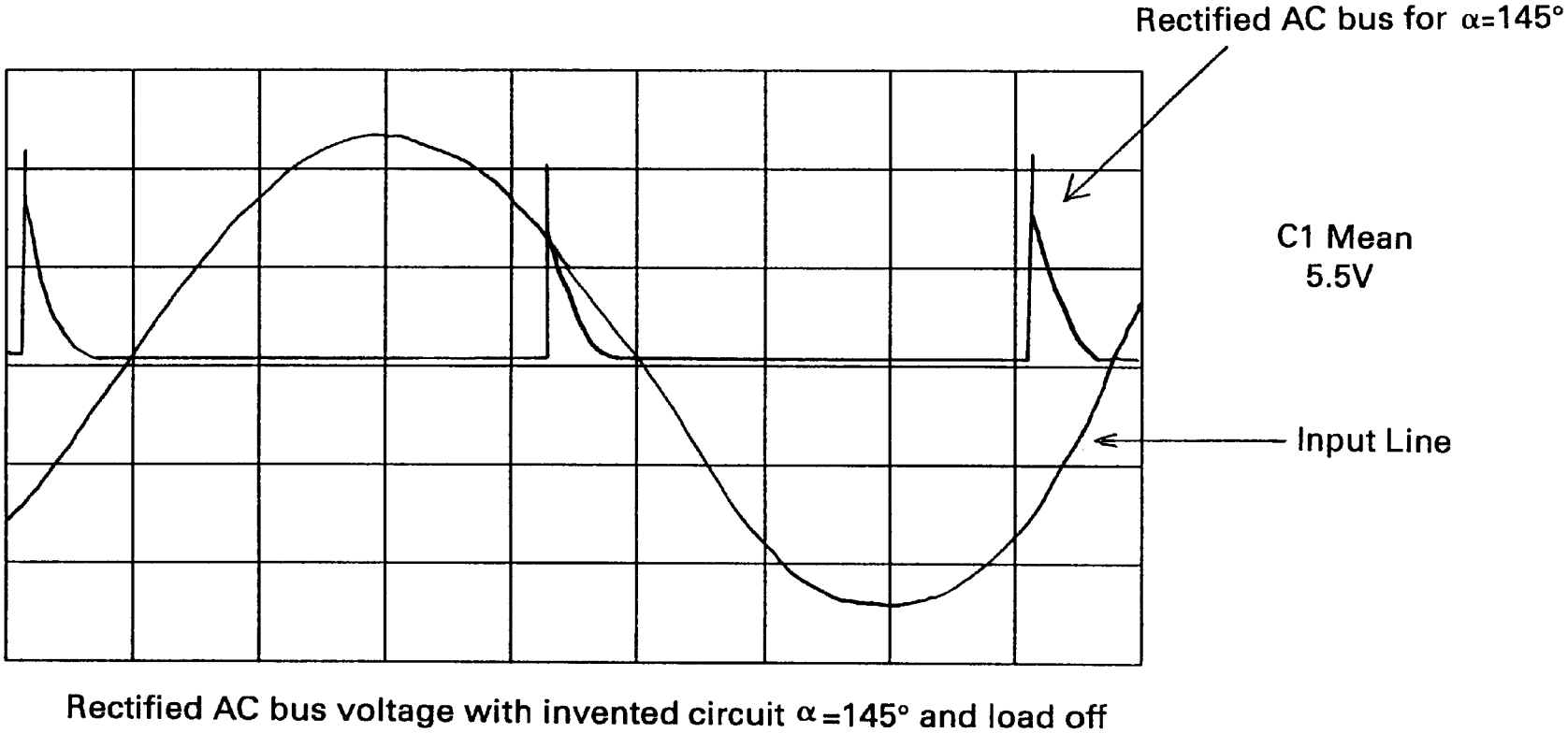
FIG. 6 graphically illustrates a rectified AC bus voltage with the load disconnected for a system such as that of FIG. 1 employing a housekeeping power supply such as that of FIG. 5.

FIG. 6 illustrates the rectified AC bus voltage without the output load, but with the circuit of FIG. 5 connected thereto. FIG. 6 shows a measured mean rectified voltage value of 5.5V without the load, which is even less than with the output load connected thereto. The design of the control circuit thus can be simplified to have just one comparator, for example, i.e., for turning off the output load when the mean rectified AC voltage falls below, for example, 9V (for $\alpha$=145°) and for turning it on again when it goes above 9V.

Diode D5 is provided in the housekeeping power supply of FIG. 5 in order to effectively separate the resistor R4 from the rest of the circuit in order to reduce energy losses during normal circuit operation when the output load is on.

Advantageously, the housekeeping power supply circuit of FIG. 5 is a very simple, low-cost solution to the problem described hereinabove. Furthermore, dissipation losses are low because the circuit operates only when the triac's firing angle of the dimmer circuit is relatively large. When the critical angle is 145°, for example, the total dissipation would be only Vmean·Idl≈180 mW. Hence, a low-power resistor R4 and a low-power MOSFET M1 can be advantageously employed.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A housekeeping power supply coupled to a rectified AC voltage bus for supplying an electronically controlled load, comprising:

a semiconductor switch coupled in series with the rectified AC voltage bus, the semiconductor switch having its gate coupled to the series combination of an additional switch and a Zener diode, the cathode of the Zener diode being coupled to the additional switch, and the anode of the Zener diode being coupled to a reference potential;

a resistive voltage divider comprising a pair of resistors coupled between an output DC voltage bus and the reference potential such that the additional switch is connected to a junction joining the pair of resistors;

a first capacitor coupled across the resistive voltage divider between the output DC voltage bus and the reference potential;

a voltage source coupled to the output DC voltage bus;

a current sink coupled to load the output DC voltage bus so as to sink current whenever the semiconductor switch is turned on;

a second capacitor coupled between the rectified AC voltage bus and the reference potential, the second capacitor having a capacitance lower than that of the first capacitor, the second capacitor discharging through the resistive voltage divider when the semiconductor switch is off, such that when the voltage across the second capacitor decreases to a mean rectified AC voltage threshold level, a negative feedback circuit is formed through the resistive voltage divider, the additional switch, and the Zener diode which provides sufficient current to turn on the semiconductor switch in order to maintain the mean rectified AC bus voltage about or less than the threshold level.

2. The housekeeping power supply of claim 1 wherein the current sink comprises a resistance.

3. The housekeeping power supply of claim 1, further comprising a second diode for separating the current sink from the rest of the housekeeping power supply when the electronically controlled load is connected thereto in order to reduce energy losses.

4. The housekeeping power supply of claim 1 wherein the voltage source comprises an inductive winding.

* * * * *